US010729254B2

(12) United States Patent
Wheat

(10) Patent No.: US 10,729,254 B2
(45) Date of Patent: Aug. 4, 2020

(54) FURNITURE ACCESSORY STORAGE SYSTEM AND METHOD

(71) Applicant: Joseph Wheat, Indianapolis, IN (US)

(72) Inventor: Joseph Wheat, Indianapolis, IN (US)

( * ) Notice: Subject to any disclaimer, the term of this patent is extended or adjusted under 35 U.S.C. 154(b) by 476 days.

(21) Appl. No.: 15/669,726

(22) Filed: Aug. 4, 2017

(65) Prior Publication Data

US 2018/0035817 A1 Feb. 8, 2018

Related U.S. Application Data

(60) Provisional application No. 62/371,498, filed on Aug. 5, 2016.

(51) Int. Cl.
*A47C 21/00* (2006.01)
*A47C 7/62* (2006.01)

(52) U.S. Cl.
CPC ..... *A47C 21/00* (2013.01); *A47C 7/62* (2013.01)

(58) Field of Classification Search
CPC ..... A47C 21/00; A47C 7/62
See application file for complete search history.

(56) References Cited

U.S. PATENT DOCUMENTS

| | | | | |
|---|---|---|---|---|
| 6,253,399 | B1 | 7/2001 | Wagner | |
| 6,848,132 | B1 | 2/2005 | Dale | |
| 7,621,496 | B2 | 11/2009 | Cancilliari | |
| 8,578,528 | B1 * | 11/2013 | Heare | A47C 21/00 108/49 |
| 8,909,839 | B2 | 12/2014 | Petrick | |
| 9,095,222 | B2 | 8/2015 | Asaf | |
| 2004/0261175 | A1 * | 12/2004 | May | A47C 7/62 5/503.1 |
| 2011/0084040 | A1 * | 4/2011 | Curtin | A47B 23/00 211/126.7 |
| 2013/0312185 | A1 * | 11/2013 | Suh | A47C 20/043 5/618 |

* cited by examiner

*Primary Examiner* — David R Hare
*Assistant Examiner* — Adam C Ortiz
(74) *Attorney, Agent, or Firm* — Acumen Intellectual Property; Michael C. Balaguy

(57) ABSTRACT

A furniture accessory storage system includes an outer basket receptacle, an inner basket liner, and a support extension piece that is configured to selectably couple with the outer basket receptacle and provide adjustable support by holding the system in place adjacent to the interstitial space of a furniture item. The furniture accessory storage system is useful for storing and organizing commonly used household accessories near a bedside, living room couch, or other furniture item.

5 Claims, 5 Drawing Sheets

FURNITURE ACCESSORY STORAGE SYSTEM AND METHOD

CROSS-REFERENCE TO RELATED APPLICATION

The present application is related to and claims priority to U.S. Provisional Patent Application No. 62/371,498 filed Aug. 5, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of receptacles and more specifically relates to accessory organizers.

2. Description of Related Art

There are many items that individuals need nearby as they go to bed. Items, such as phones, remotes, books, tablet computers, and more need to be close and accessible so that users may reach for them when desired. Some individuals have nightstands, however these quickly become cluttered and some do not have space in their bedroom for a table. Placing items on the floor can cause damage to the items, and setting the items on the bed may result in the items falling off of the bed and interrupting sleep. Individuals may potentially get out of bed to search for the fallen object. A more efficient alternative is needed.

U.S. Pat. No. 8,578,528 to Greg Heare relates to an accessory storage system. The described accessory storage system includes an accessory storage system used with a mattress unit and a box springs unit. The system has a mounting member with a generally planar bed securing member and a generally planar storage securing member. The system has a storage member with a large storage cavity and a small storage cavity. The small storage cavity is located on the large storage cavity. For use, the mounting member is pivoted fully open to about a ninety degree angle. The bed securing member is fully inserted in between a mattress unit bottom surface and a box springs unit top surface. The back surface of the storage securing member is located flush against the mattress unit. The first large storage cavity side is located flush against the front surface of the storage securing member and held securely into place via the securing slots and the securing extensions.

BRIEF SUMMARY OF THE INVENTION

In view of the foregoing disadvantages inherent in the known receptacles art, the present disclosure provides a novel furniture accessory storage system and method. The general purpose of the present disclosure, which will be described subsequently in greater detail, is to provide a receptacle for storing personal accessories that may be configured for removably coupling to a furniture item.

A furniture accessory storage system is disclosed herein. The furniture accessory storage system may include an outer basket receptacle, an inner basket liner, and a support extension piece that is configured to selectably couple with the outer basket receptacle and provide adjustable support by holding the system in place adjacent to the interstitial space of a furniture item.

According to another embodiment, a method for using the furniture accessory storage system is also disclosed herein. The method for using the furniture accessory storage system may include placing the inner basket liner within the outer basket receptacle, adjusting the height of the outer basket receptacle, and inserting the support extension piece within a furniture item.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a furniture accessory storage system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an accessory organizer and more particularly to a furniture accessory storage system as used to improve the storage of personal items and accessories in proximity of a furniture item.

Generally, the present invention may provide users with a convenient and accessible location for storing items that are commonly used while in bed. This device may effectively eliminate the occurrence of needing to place items on the floor or on the bed. It may also allow individuals to remain in bed while effortlessly reaching for the items they need. The furniture accessory storage system may additionally be useful for replacing a nightstand or for keeping a multitude of items cluttered on a bedside table. The present invention offers a close and accessible alternative to other bedroom storage devices.

The item of this disclosure may specifically be used for placing cell phones, tv remotes, or other hand-held items that may commonly be used in bed or near a sofa, into a basket or receptacle that is non-permanently attached to the bed. This may benefit the user by keeping their personal items organized without having to worry about sitting on them or knocking them off of a bed our couch while sleeping.

In one embodiment, the disclosed item may include a plastic basket with 2 flat prong-like extensions, which may be placed between the mattress and box spring of a bed. The included basket may be approximately as high as the thickness of the bed. Not all people (specifically college students and young entrepreneurs) own a bedstand or coffee table that may commonly be positioned next to a bed or living room sofa. This furniture accessory storage system may provide an inexpensive and novel solution for people in that situation.

Alternate embodiments of the furniture accessory storage system may include a basket or storage compartment that includes at least one removable liner. This may allow a user to remove the liner for easy cleaning and storage. Additional features may include a height adjustment mechanism with a notched adjuster on the basket and/or the furniture coupling assembly. The furniture accessory storage system may be constructed from metals, plastics, rubber, and other soft polymers that may be durable and easily cleaned.

Figure 1:
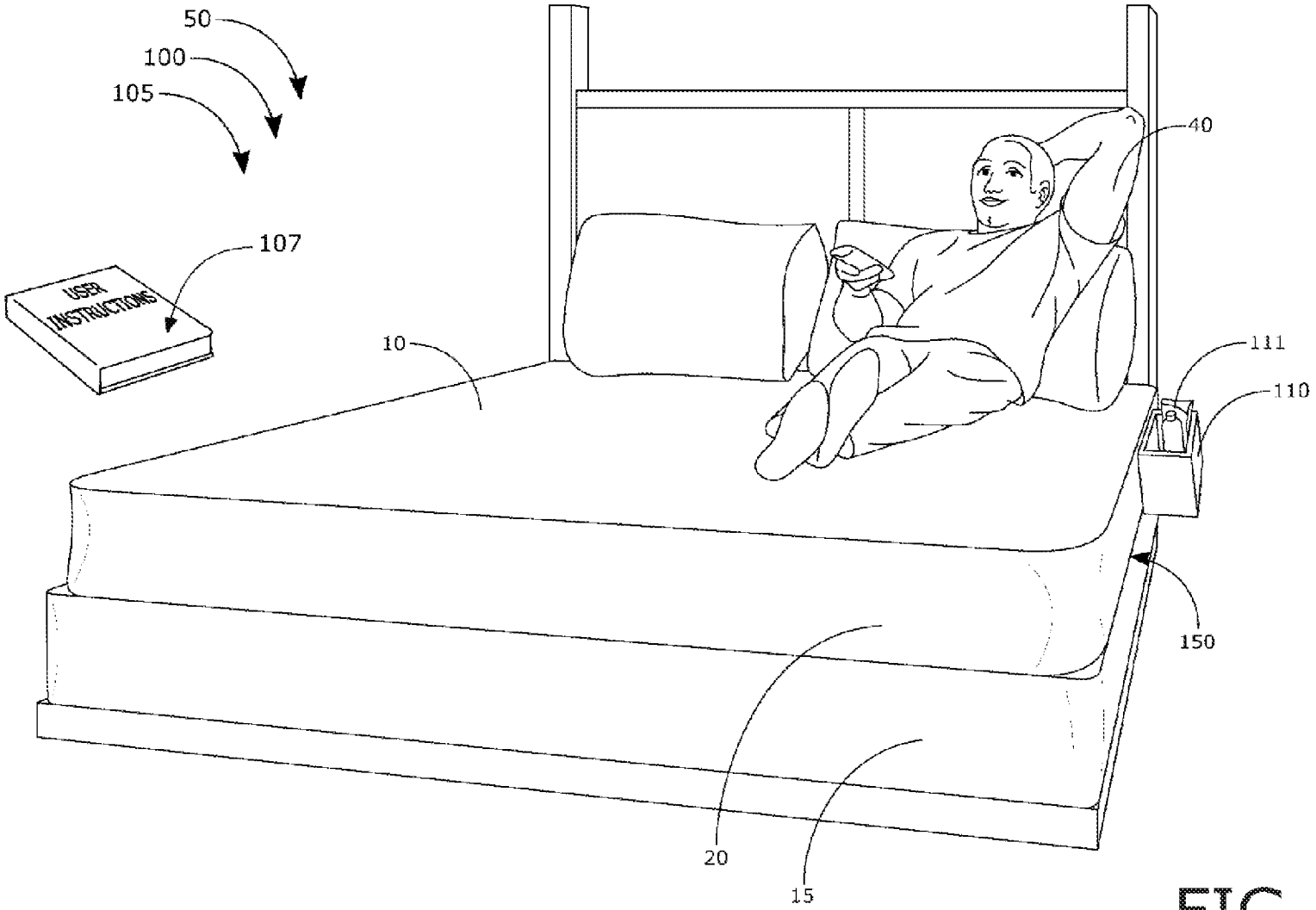
FIG. 1 is a perspective view of the furniture accessory storage system during an 'in-use' condition, according to an embodiment of the disclosure.

Referring now more specifically to the drawings by numerals of reference, there is shown in FIGS. 1-4, various views of a furniture accessory storage system 100. FIG. 1 shows a furniture accessory storage system 100 during an 'in-use' condition 50, according to an embodiment of the present disclosure. Here, the furniture accessory storage system 100 may be beneficial for use by a user 40 for storage of personal items and accessories in proximity of a furniture item 10 having a support frame 15 and a cushion 20. As illustrated, the furniture accessory storage system 100 may include an outer basket receptacle 110 (also referred to as an organizer) having an inner volume 111 which may be configured to be inserted within an interstitial space 150 of a furniture item 10. Outer basket receptacle 110 may have an underside 200 and an upperside 210 opposite the underside 200. Upperside 210 may define inner volume 111.

According to one embodiment, the furniture accessory storage system 100 may be arranged as a kit 105. In particular, the furniture accessory storage system 100 may further include a set of instructions 107. The instructions 107 may detail functional relationships in relation to the structure of the furniture accessory storage system 100 (such that the furniture accessory storage system 100 can be used, maintained, or the like, in a preferred manner).

Figure 2:
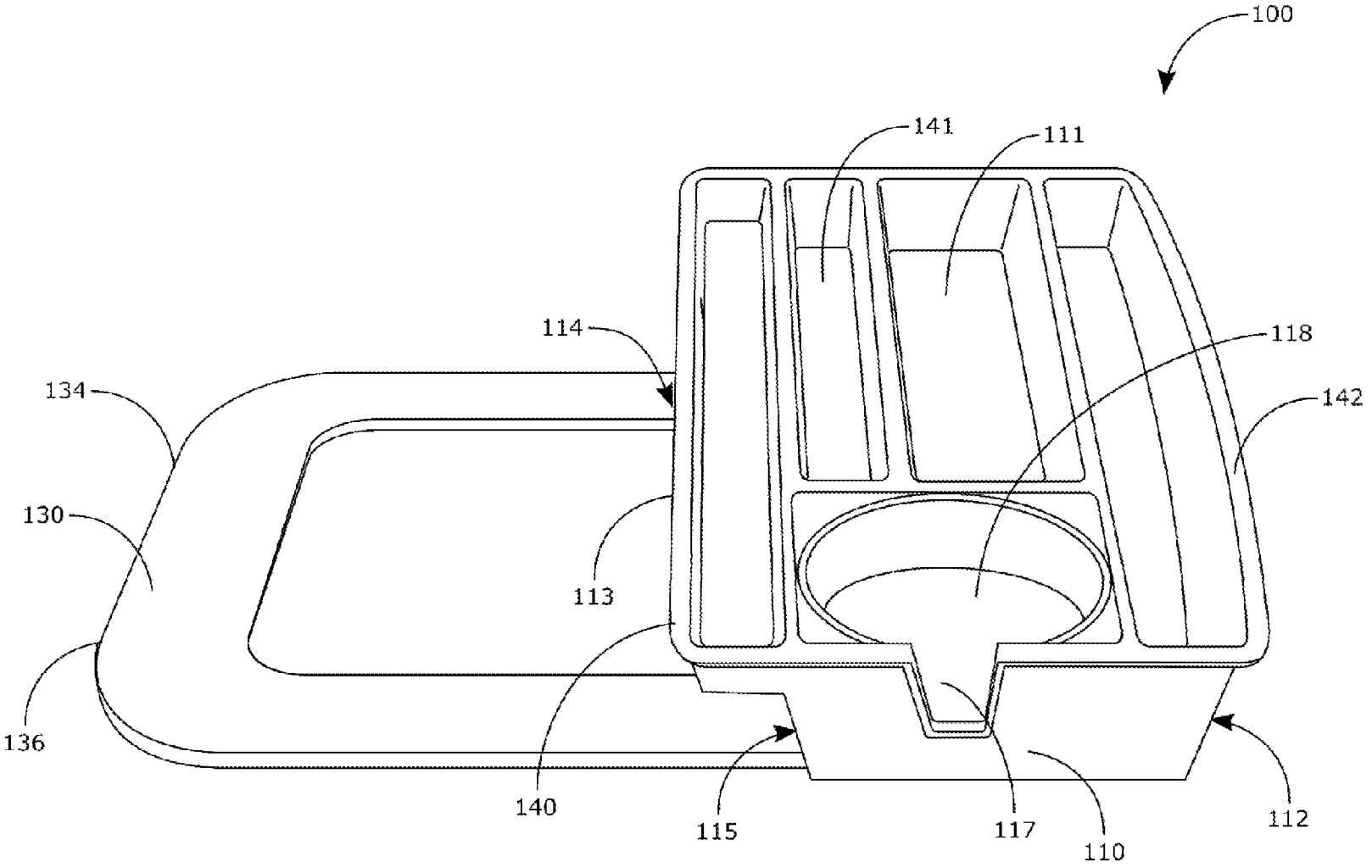
FIG. 2 is a side view of the furniture accessory storage system of FIG. 1, according to an embodiment of the present disclosure.

FIG. 2 shows the furniture accessory storage system 100 of FIG. 1, according to an embodiment of the present disclosure. As above, the furniture accessory storage system 100 may include an outer basket receptacle 110 having an inner volume 111, a front side 112, a backside 113 having a left connection site 114 (also referred to as a first-aperture) and a right connection site 115 (also referred to as a second-aperture), a bottom surface 117, and a main opening 118 defined by a perimeter wall circumscribing the bottom surface 117. Outer basket receptacle may be further defined by length 220, width 222, right-side 224, left-side 226, and outer-sidewall 240. Further, inner volume 111 may be shaped and divided into first-longitudinal subcompartment 250, second-longitudinal subcompartment 252, third-longitudinal subcompartment 254, fourth-longitudinal subcompartment 256, and circular cupholder (or main opening) 118. First-longitudinal subcompartment 250 may be along right-side 224 and second-longitudinal subcompartment 252 may be along 226. Trays 250, 252, 254, and 256 may each be parallel to each other and may each be rectangular in shape. Circular cupholder 118 may be proximate to front side 112 and may take the shape of a cylindrical bore able to accept a beverage cup. Trays 254 and 256 may together be disposed between subcompartments 250 and 252, and may be placed between circular cupholder 118 and backside 113.

The furniture accessory storage system 100 may further include a support extension piece 130 (or planar member) having a furniture securing end 134 (having a first-tine and a second-tine as illustrated) with rounded edges 136 configured for insertion within an interstitial space 150 of a furniture item 10 (150 and 10 not featured in FIG. 2; please refer to FIG. 1). The included rounded edges 136 may assist in helping to prevent damage to the furniture item 10.

The furniture accessory storage system 100 may additionally feature an inner basket liner 140, which may be configured to fit securely within said outer basket receptacle 110. The inner basket liner 140 may include a plurality of compartments 141 and a perimeter lip 142 (also referred to as a rounded lip) configured to extend around the top edge of the outer basket receptacle 110.

Figure 3:
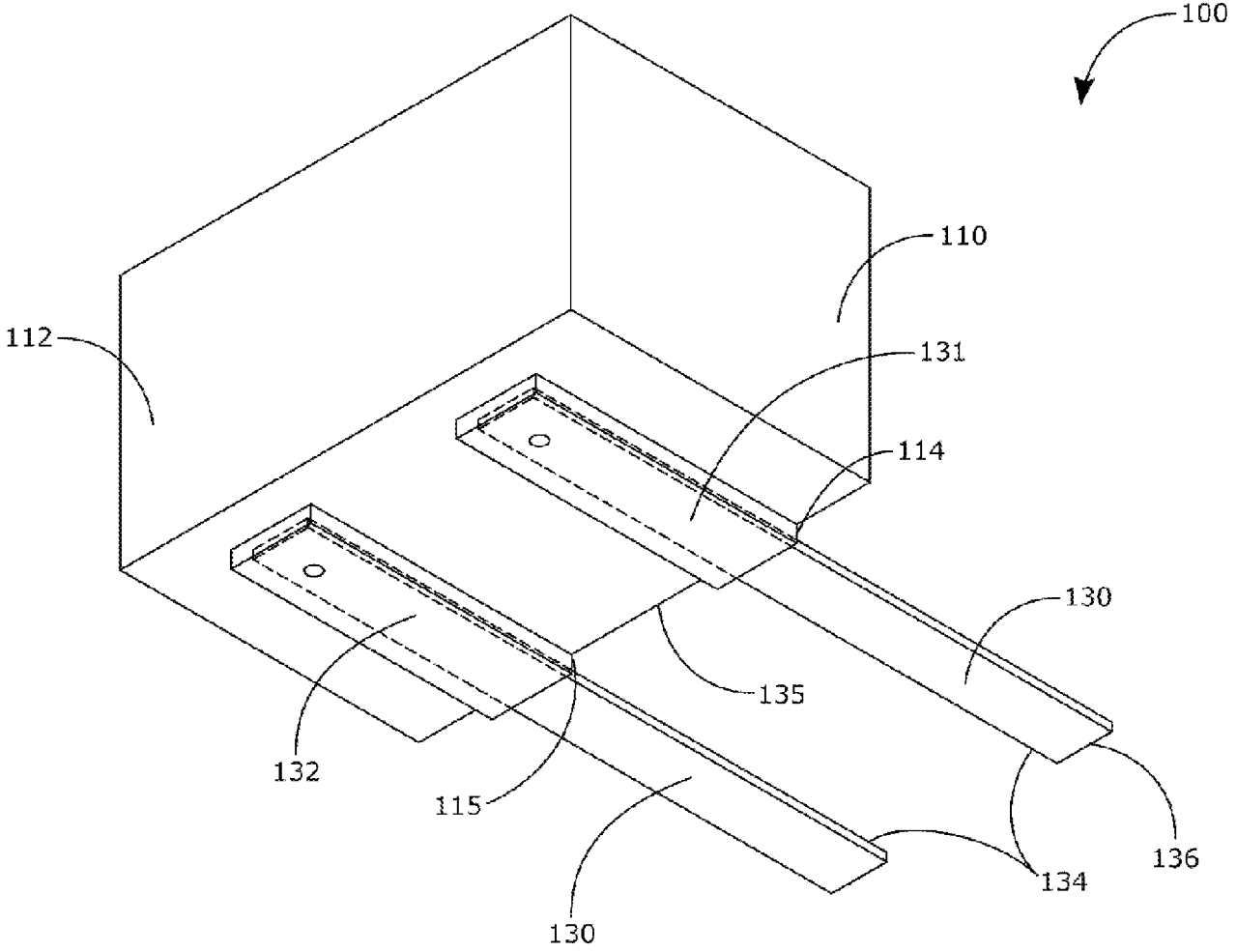
FIG. 3 is a bottom perspective view of the furniture accessory storage system of FIG. 1, according to an embodiment of the present disclosure.

FIG. 3 is a bottom perspective view of the furniture accessory storage system 100 of FIG. 1, according to an embodiment of the present disclosure. The furniture accessory storage system 100 may include an outer basket receptacle 110 having a front side 112, a left connection site 114, and a right connection site 115. The furniture accessory storage system 100 may additionally include a support extension piece 130 having a left groove fitting 131, a right groove fitting 132, a furniture securing end 134, and a connecting end 135. The furniture securing end 134 of the support extension piece 130 may include rounded edges 136 configured to prevent or reduce damage during use.

Figure 4:
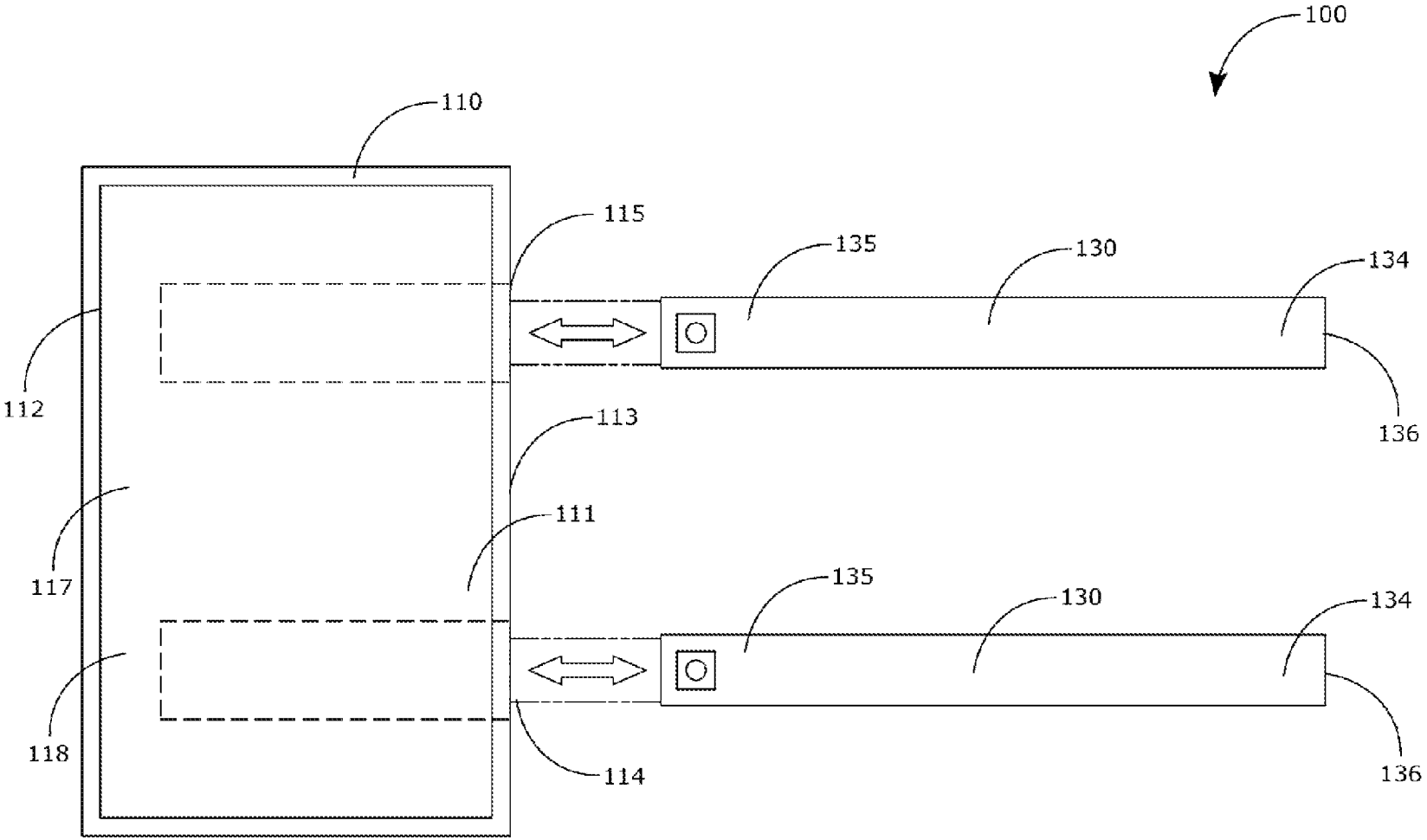
FIG. 4 is a top view of the furniture accessory storage system of FIG. 1, according to an embodiment of the present disclosure.

FIG. 4 is a top view of the furniture accessory storage system 100 of FIG. 1, according to an embodiment of the present disclosure. The furniture accessory storage system 100 may feature an outer basket receptacle 110 having an inner volume 111, a front side 112, a backside 113 having a left connection site 114, and a right connection site 115, a bottom surface 117, and a main opening 118 defined by a perimeter wall circumscribing the bottom surface 117. The left connection site 114 may be configured to retain a support extension piece 130 having a connecting end 135 and a furniture securing end 134, the furniture securing end 134 featuring rounded edges 136. Similarly, the right connection site 115 may also be configured to retain a support extension piece 130 having a connecting end 135 and a furniture securing end 134, the furniture securing end 134 featuring rounded edges 136.

Figure 5:
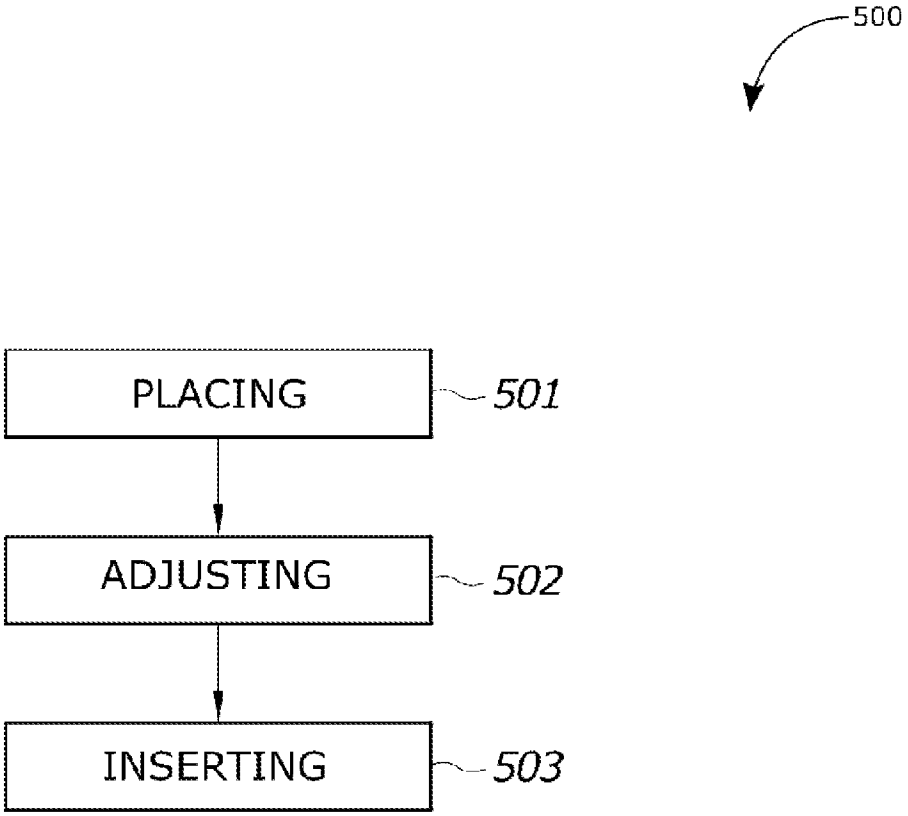
FIG. 5 is a flow diagram illustrating a method of use for a furniture accessory storage system, according to an embodiment of the present disclosure.

FIG. 5 is a flow diagram illustrating a method for using 500 a furniture accessory storage system 100, according to an embodiment of the present disclosure. In particular, the method for using 500 the furniture accessory storage system 100 may include one or more components or features of the furniture accessory storage system 100 as described above. As illustrated, the method for using 500 the furniture accessory storage system 100 may include the steps of: step one

501, placing the inner basket liner 140 within the outer basket receptacle 110; step two 502, adjusting the height of the outer basket receptacle 110; and step three 503, inserting the support extension piece 130 within a furniture item 10.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the furniture accessory storage system 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A furniture accessory storage system, the system comprising:

an organizer having an underside including a first-rectangular channel having a first-aperture, and a second-rectangular channel having a second-aperture, an upperside opposite the underside, the upperside including a length separating a bottom-edge and a top-edge, a width separating a right-side and a left-side, an outer-sidewall bounding the upperside, a first-longitudinal subcompartment along the right-side, a second-longitudinal subcompartment along the left-side, the second-longitudinal subcompartment paralleling and mirroring the first-longitudinal subcompartment, a circular cupholder disposed proximally to the bottom-edge and between the first-longitudinal subcompartment and the second-longitudinal subcompartment, a third-longitudinal subcompartment disposed between the circular cupholder and the top-edge, and a fourth-longitudinal subcompartment disposed between the circular cupholder and the top-edge, wherein the first-longitudinal subcompartment, the second-longitudinal subcompartment, the third-longitudinal subcompartment, and the fourth-longitudinal subcompartment are each rectangular in shape and each are parallel to each other; and a bed-mount having a planar member able to be sandwiched between a mattress and a bedspring, a first-tine projecting outwardly from the planar member, the first-tine being able to be inserted into the first-rectangular channel, and a second-tine projecting outwardly from the planar member, the second-tine being able to be inserted into the second-rectangular channel, the first-tine being parallel to the first-tine, wherein the organizer is able to be supported by and cantilevered from the bed-mount when the bed-mount is sandwiched between a mattress and a bedspring, the first-tine is inserted into the first-rectangular channel, and the second-tine is inserted into the second-rectangular channel.

2. The furniture accessory storage system of claim 1, further comprising an inner basket liner conforming to the shape of the upperside, such that the inner basket liner may be removably nested upon the upperside.

3. The furniture accessory storage system of claim 1, wherein the outer-sidewall further comprises a rounded lip.

4. The furniture accessory storage system of claim 1, wherein the upperside is detachable from the underside.

5. The furniture accessory storage system of claim 4, wherein the underside comprises a bucket within which the upperside may nest.

* * * * *